US005261339A

United States Patent [19]

Rachor

[11] Patent Number: 5,261,339

[45] Date of Patent: Nov. 16, 1993

[54] BUTTON-HOLDING DEVICE ON A BUTTON-SEWING MACHINE

[75] Inventor: Heinrich Rachor, Goldbach, Fed. Rep. of Germany

[73] Assignee: Union Special GmbH, Stuttgart, Fed. Rep. of Germany

[21] Appl. No.: 793,797

[22] Filed: Nov. 18, 1991

[30] Foreign Application Priority Data

Nov. 29, 1990 [DE] Fed. Rep. of Germany ... 9016237[U]

[51] Int. Cl.[5] ..... D05B 3/16

[52] U.S. Cl. ..... 112/108; 112/113; 112/114

[58] Field of Search ..... 112/108, 113, 114, 112, 112/115, 107, 104; 414/744.8

[56] References Cited

U.S. PATENT DOCUMENTS

| | | | |
|---|---|---|---|
| 2,360,471 | 10/1944 | Brussell | 112/114 |
| 3,033,137 | 5/1962 | Ross . | |
| 3,175,703 | 3/1965 | Young, Jr. | 112/113 X |
| 4,594,953 | 6/1986 | Ando et al. | 112/113 X |
| 4,712,493 | 12/1987 | Aso et al. | 112/112 |
| 4,854,252 | 8/1989 | Asao et al. | 112/113 X |
| 4,884,517 | 12/1989 | Asao et al. | 112/112 |

FOREIGN PATENT DOCUMENTS

| | | | |
|---|---|---|---|
| 3004895 | 1/1991 | Japan | 112/112 |
| 3103286 | 4/1991 | Japan | 112/113 |

*Primary Examiner*—Clifford D. Crowder
*Assistant Examiner*—Paul C. Lewis
*Attorney, Agent, or Firm*—Willian Brinks Olds Hofer Gilson & Lione

[57] ABSTRACT

In a button-holder for a button-sewing machine, two clamp parts (8,9) for the button (7) are guided in a parallel guide holder (28) so as to be movable by a pneumatic cylinder (34) in opposite directions. The parallel guide holder (28) is swingable horizontally by a pneumatic cylinder (17) to displace the clamp parts (8,9) from a sewing position (A) to a resting position (B).

Thus, the button-holder does not require adjustment for different sized buttons and the button can be inserted away from the sewing region.

7 Claims, 4 Drawing Sheets

BUTTON-HOLDING DEVICE ON A BUTTON-SEWING MACHINE

BACKGROUND OF THE INVENTION

The invention relates to a button-holding device on a button-sewing machine.

A button holder on a button-sewing machine is known from U.S. Pat. No. 3,033,137. In this holder, two mutually opposed clamp parts are provided for receiving an eye button or shank button and are movable vertically and relative to one another as well as with one another. Although buttons of different types and sizes can be held by this holder, it is necessary to adjust the button-holder to the size of the button in each case. Moreover, the button-holder is disposed directly in the sewing region when in its resting position, that is, when in its open position, and can endanger the operator.

An object of the invention is to design a button-holder on a sewing machine in such a way that it is possible to insert buttons of different types and sizes into the holder outside the direct sewing region without further adjustment of the button clamp.

SUMMARY OF THE INVENTION

The present invention resides in a button-holding device having two clamp parts for receiving a button to be sewn in a sewing position to a workpiece on a button-sewing machine having a sewing needle, in which the two clamp parts are guided so as to be movable in opposite directions towards one another and are driven so as to be movable between the sewing position and a resting position remote from the sewing position.

The construction in accordance with the invention provides a method which makes it possible to insert different buttons, such as eye buttons, shank buttons and spherical buttons of different types and sizes into the clamp parts of the holding device (also called a button clamp) outside the sewing or stitch-forming position and to move the clamp parts into the sewing position.

Further advantageous constructions of the subject in accordance with claim 1 are set forth in the subclaims.

By guiding and moving the clamp parts in opposite directions to one another by means of an intermediate guide link or crank, a simple solution to holding the buttons in a reliable manner without varying the centre position of the button relative to the sewing needle may be achieved.

Driving the crank by means of a pneumatic cylinder and driving a parallel guide holder for the clamp parts by means of another pneumatic cylinder provides particularly simple structural solutions to moving the parts of the button clamp in a driven manner.

Preferably, the clamp parts are restrained for parallel movement in two flat guides in a parallel guide holder. This provides a low-wear and maintenance-free design.

Advantageously, an adjustable stop is provided to locate the clamp parts in the sewing position. The parallel guide holder can be swingable horizontally and can engage against such a stop. This makes it possible to align the clamp parts adjustably and laterally towards the position of the needle of the button-sewing machine.

BRIEF DESCRIPTION OF THE DRAWINGS

The invention is further described, by way of example, with reference to the accompanying drawings, in which.

DETAILED DESCRIPTION OF PREFERRED EMBODIMENTS

Figure 1:
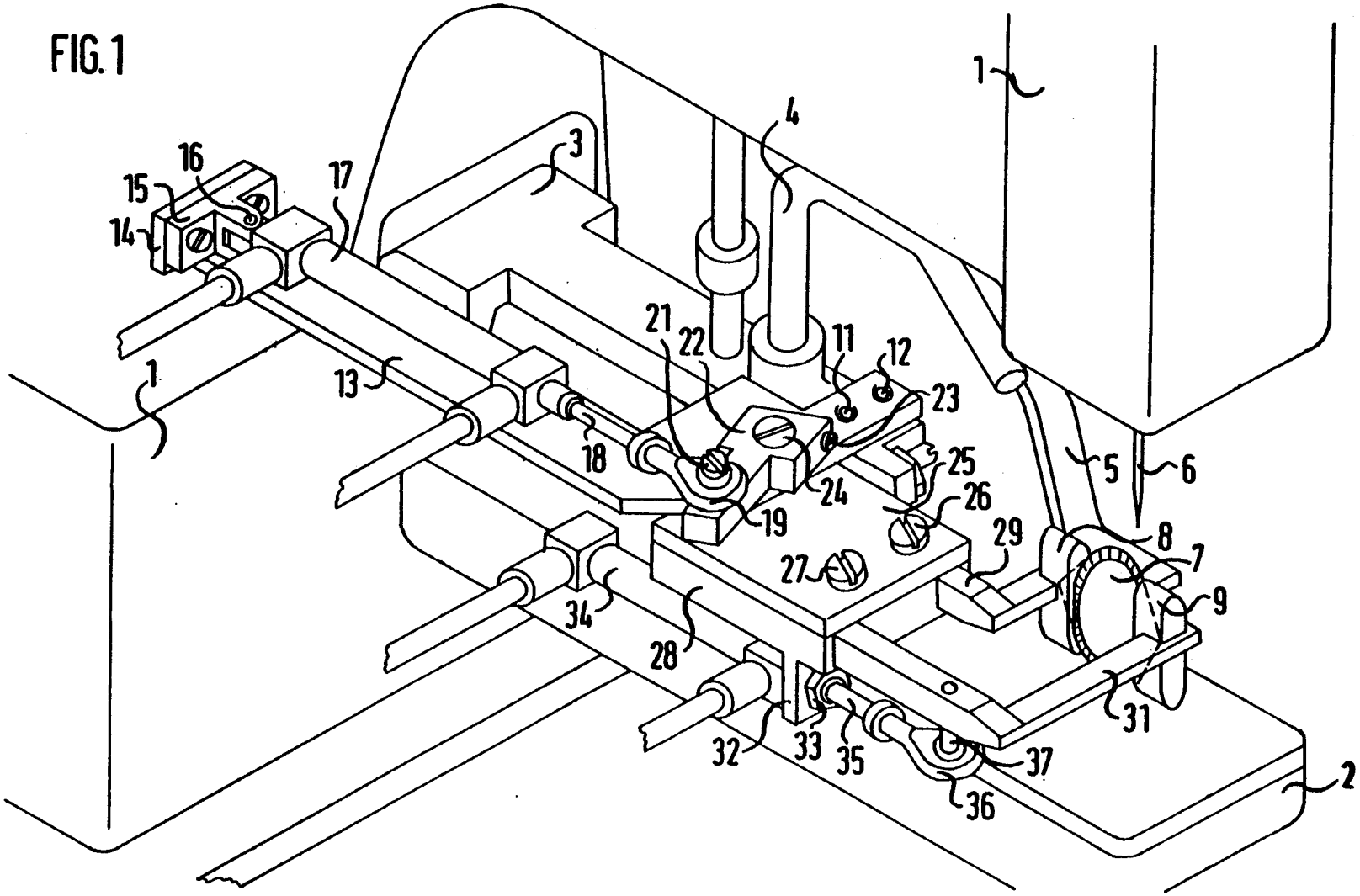
FIG. 1 is a perspective view of a button-holder in a fragmentary view of a button-sewing machine.

Referring to FIG. 1, a button-sewing machine has a housing I with a free arm 2. A clamp support 3, pivotably mounted in the housing 1 and driven so as to be swingable up and down in a known manner, carries a bent lifter rod 4 whose free end has a presser foot 5. A sewing needle 6, which is also driven so as to be movable up and down, makes it possible, with a looper (not shown in the drawing) in the free arm 2, to sew on a button 7 which is held and positioned by respective clamp parts 8 and 9.

An angled support plate 13 is secured to the clamp support 3 by means of respective screws 11 and 12, and its angled end 14 carries a pivotable receiving element 15 to which a double-acting pneumatic cylinder 17 is pivotably secured by means of a pin 16. A reciprocable piston rod 18 carries a ball head 19 which is articulated to a pivoted arm 22 by way of a pin 21, the pivoted a=22 in turn being secured to a stud 24 by means of a threaded pin 23. The stud 24 is pivotably mounted in the support plate 13 and is disposed on a cover plate 25 which is secured by respective screws 26 and 27 to a parallel guide holder 28 (also called a holder 28), whereby the holder 28 is pivotably mounted on the clamp support 3. Angled arms 29 and 31, with the clamp parts 8 and 9 secured thereto, are guided in the parallel guide holder 28 so as to be movable in opposite directions to one another. The parallel guide holder 28 carries a vertical reception plate 32 for receiving a further double-acting pneumatic cylinder 34 secured by means of a nut 33. A piston rod 35 carries a ball head 36 which is connected to the angled arm 31 by way of a pin 37.

Figure 2:
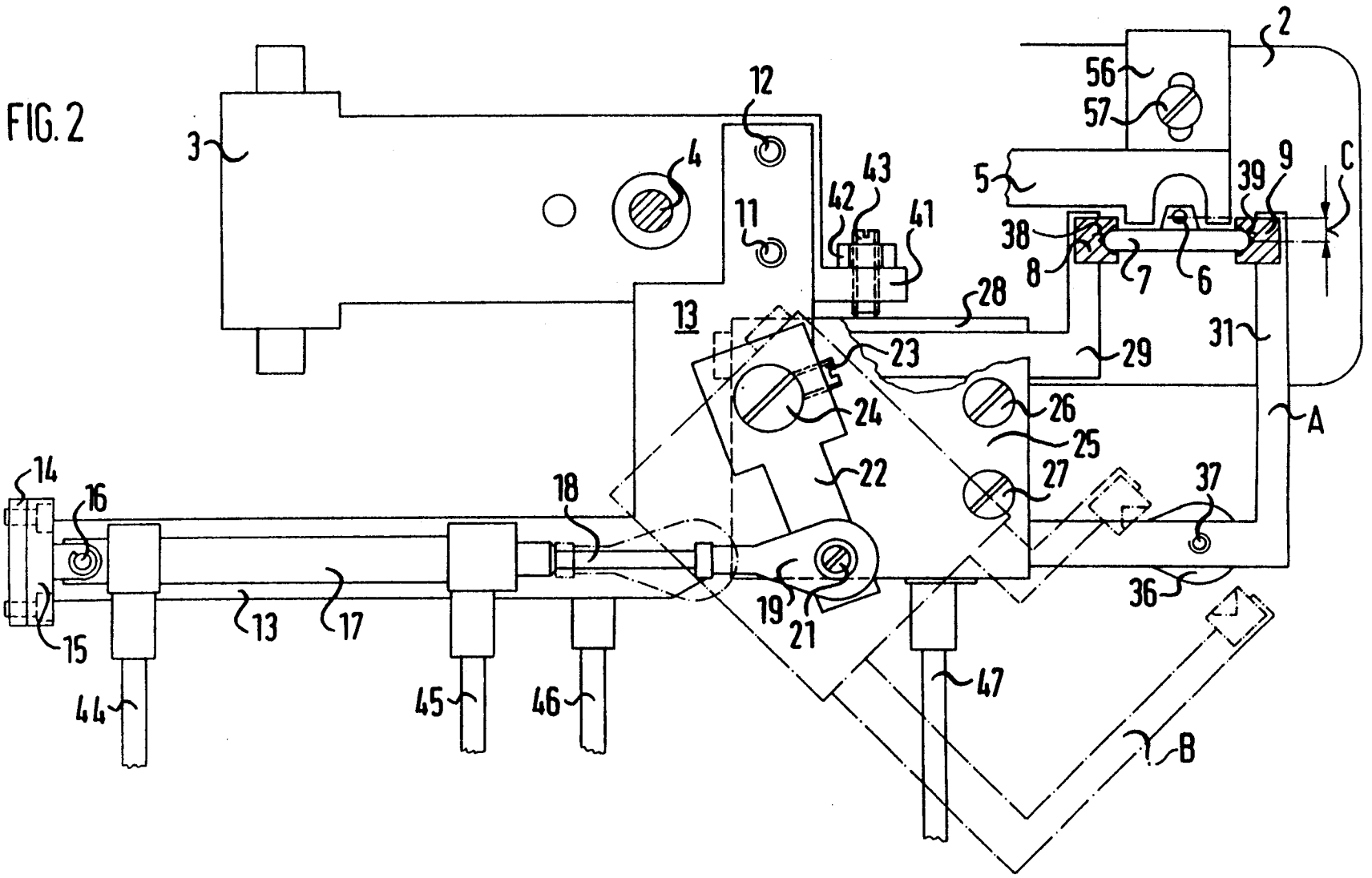
FIG. 2 is a plan view of the button-holder.

FIG. 2 shows the button-holder in a sewing position A shown by solid lines, and in a resting position B which is shown by dash-dot lines and which is located outside the sewing or stitch-forming position A prescribed by the position of the sewing needle 6 and the sewing movement of the clamp support 3. The clamp parts 8 and 9 have angled, prism-shaped recesses 38, 39 which make it possible to receive buttons of different sizes in a central position.

The clamp support 3 has a shoulder 41 carrying a threaded pin 43 which is secured by a nut 42 and which serves as an adjustable stop for the parallel guide holder 28 and thus makes it possible to adjust the clamp parts 8 and 9 laterally at a distance C from the sewing needle 6. The pneumatic cylinders 17 and 34 have flexible pneumatic tubes 44, 45, 46 and 47 which connect the pneumatic cylinders to a control unit (not shown) and to actuating valves.

Figure 3:
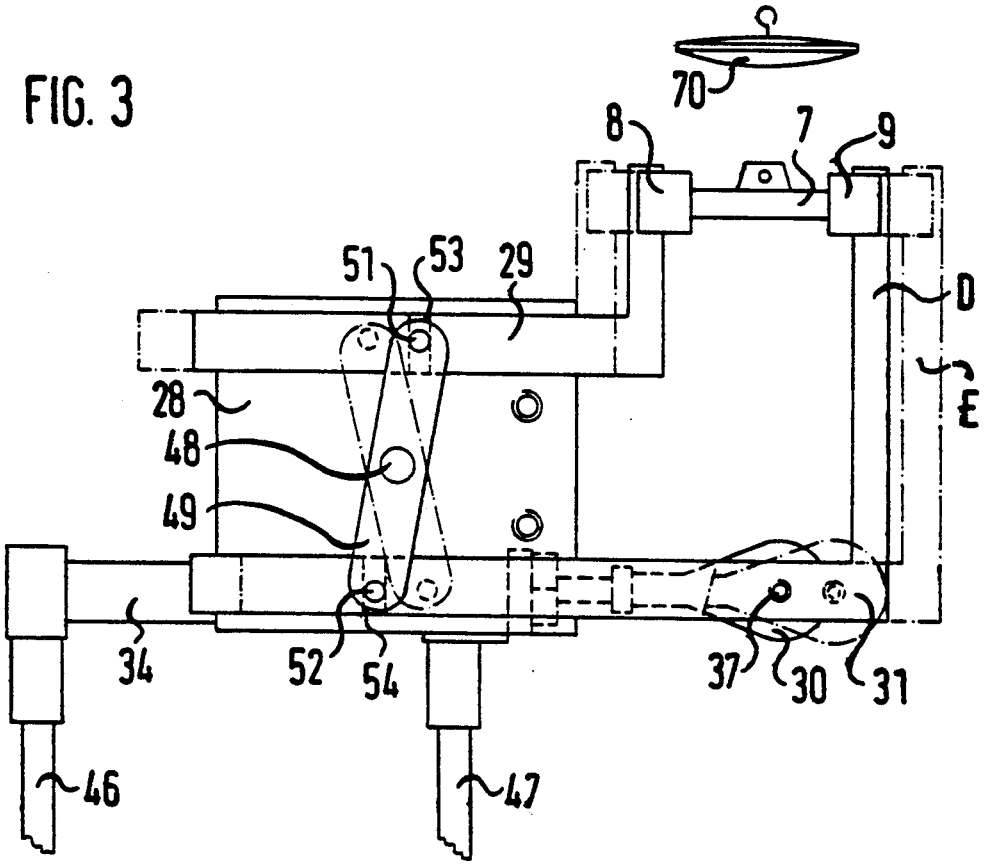
FIG. 3 is a plan view of a part of the button-holder.

FIG. 3 shows the button-holder without the cover plate 25. In intermediate guide crank 49 pivotable about a pin 48 has respective guide pins 51 and 52 which engage respective grooves 53 and 54 in the angled arms 29 and 31 which are guided in the parallel guide holder 28 so as to move in opposite directions to one another. The button 7 is held in the position D shown by solid lines. Position E shows the clamp parts 8 and 9 opened.

The button 7 is a shank button, and a button 70 is an eye button.

Figure 4:
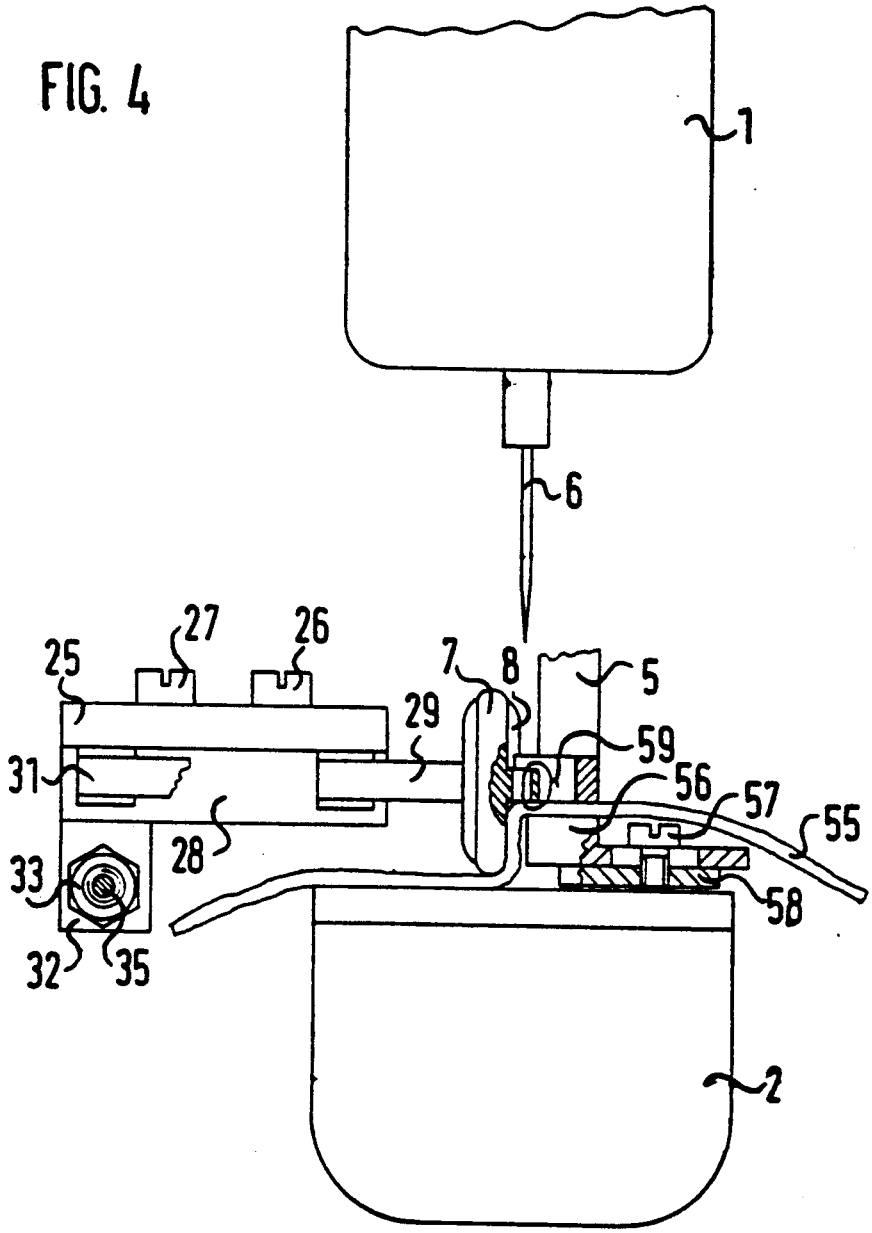
FIG. 4 is a fragmentary front view of a button-holder on a button-sewing machine.

FIG. 4 shows the sewing-on position of the button 7. A workpiece 55 is held between the presser foot 5 and a support member 56 which is in turn adjustably secured to a plate 58 by means of a screw 57, which plate 58 moves back and forth in a known manner and thus makes it possible to sew the button 7 to the workpiece 55 with a sewing thread 59.

Before commencement of the entire button-sewing operation, the two clamp parts 8 and 9 are in the resting position B shown in dash-dot lines in FIG. 2 and in the open position E shown in dash-dot lines in FIG. 3. After the button 7, 70 has been inserted between the clamp parts 8, 9, the latter are closed as shown in position D of FIG. 3 by the admission of compressed air to the pneumatic cylinder 34 to draw the piston rod 35 into the pneumatic cylinder 34. The clamp parts 8 and 9 are pivoted out of the resting position B into the sewing position A by actuation of the pneumatic cylinder 17. After the clamp support 3 and thus also the clamp parts 8 and 9 have been lowered, the button 7 is then sewn on in a known manner.

After the sewing thread 59 has been severed in a known manner, the actuating valves receive a signal for renewed actuation of the pneumatic cylinders 17, 34 by way of the control unit, and thus open the clamp parts 8 and 9 into the position E and swing them out into the resting position B, so that a fresh button-retaining and button-sewing operation can be initiated.

I claim:

1. A button-holding device comprising two clamp parts for receiving a button to be sewn in a sewing position to a workpiece, on a button-sewing machine having a sewing needle, the two clamp parts being disposed on arms, said arms being connected by a pivotable guide link to move the clamp parts in a direction towards and away form one another and the clamp arts while holding a button being guided by a pivotable holder in a horizontal plane between a resting position remote from a sewing position and a sewing position.

2. A button-holding device according to claim 1 further comprising a pneumatic cylinder attached to the intermediate guide link for the purpose of actuating the intermediate guide link.

3. A button-holding device according to claim 1 wherein the two clamp parts are connected to angled arms which are connected to the holder so as to be guidable parallel to one another.

4. A button-holding device according to claim 3 wherein a pneumatic cylinder is attached to the holder for the purpose of moving the holder.

5. A button-holding device according to claim 1 wherein the two clamp parts are spaced at an adjustable lateral distance from the needle in the sewing position.

6. A button-holding device according to claim 5 wherein an adjustable stop is connected to the button-sewing machine and adjacent to the holder thereby allowing for the adjustment of a space between the two clamp parts.

7. A button-holding device according to claim 1 further comprising a vertical movement means for vertically moving the two clamp parts.

* * * * *

UNITED STATES PATENT AND TRADEMARK OFFICE

CERTIFICATE OF CORRECTION

PATENT NO. : 5,261,339

DATED : November 16, 1993

INVENTOR(S) : Heinrich Rachor

It is certified that error appears in the above-indentified patent and that said Letters Patent is hereby corrected as shown below:

ON THE TITLE PAGE

Item 30: under "Foreign Application Priority Data", please delete "9016237" and substitute --9016237.4--.

In column 2, line 12, delete "I" and substitute --1--.

In column 2, line 28, delete "a=22" and substitute --arm 22--.

In column 2, line 62, delete "In" and substitute --An--.

Column 4:

In claim 1, line 7, delete "form" and substitute --from--.

UNITED STATES PATENT AND TRADEMARK OFFICE

CERTIFICATE OF CORRECTION

PATENT NO. : 5,261,339

DATED : November 16, 1993

INVENTOR(S) : Heinrich Rachor

It is certified that error appears in the above-indentified patent and that said Letters Patent is hereby corrected as shown below:

In claim 1, line 7, delete "arts" and substitute --parts--.

Signed and Sealed this

Twenty-eight Day of March, 1995

Bruce Lehman

*Attest:*

BRUCE LEHMAN

*Attesting Officer*

*Commissioner of Patents and Trademarks*